United States Patent [19]

Broodman

[11] 4,332,156

[45] Jun. 1, 1982

[54] METHOD FOR THE MANUFACTURE OF PIPES BY MEANS OF EXTRUSION AS WELL AS FOR PROVIDING ONE FLANGE ON AT LEAST TWO PIPES, AND DEVICE TO CARRY OUT THE SAID METHOD

[75] Inventor: Johannus J. Broodman, Breskens, Netherlands

[73] Assignee: B. V. Koninklijke Maatschappij "de Schelde", Vlissingen, Netherlands

[21] Appl. No.: 76,833

[22] Filed: Sep. 19, 1979

[30] Foreign Application Priority Data

Sep. 28, 1978 [NL] Netherlands ..... 7809825

[51] Int. Cl.[3] ..... B21C 23/14; B21C 27/00; B21C 23/08

[52] U.S. Cl. ..... 72/264; 72/272; 72/261; 29/157.4

[58] Field of Search ..... 72/261, 264, 265, 266, 72/267, 253 R, 272, 467, 468

[56] References Cited

U.S. PATENT DOCUMENTS

| | | | |
|---|---|---|---|
| 1,395,217 | 10/1921 | Begot | 72/272 |
| 2,894,623 | 7/1959 | Walton | 72/253.1 |
| 3,347,079 | 10/1967 | Rowell | 72/264 |
| 3,355,927 | 12/1967 | Sibler | 72/261 |
| 3,527,079 | 9/1970 | Braeuninger | 72/269 |
| 3,668,757 | 6/1972 | Rieder | 72/267 X |
| 3,786,665 | 1/1974 | Creuzet | 72/269 |
| 3,948,079 | 4/1976 | Fuchs, Jr. | 72/261 |
| 4,050,279 | 9/1977 | Fuchs, Jr. | 72/261 |

FOREIGN PATENT DOCUMENTS

| | | | |
|---|---|---|---|
| 842188 | 6/1952 | Fed. Rep. of Germany | 72/266 |
| 406592 | 11/1973 | U.S.S.R. | 72/261 |
| 668735 | 6/1979 | U.S.S.R. | 72/267 |

*Primary Examiner*—Lowell A. Larson
*Attorney, Agent, or Firm*—Bucknam and Archer

[57] ABSTRACT

The invention is related to the integral extrusion of at least two pipes and a common flange to an extruding device and to a flange with at least two pipes integral with said flange. The method is characterized in that said pipes are extruded simultaneously while a common flange is formed at the same time, during which extrusion the material of the starting workpiece (blank), flowing under pressure, is forced, at a certain distance before the beginning of the extrusion openings for the pipes, to flow axially and radially into and through a transient space situated between said openings and the space reserved for the flange. By this method a flange is obtained integral with at least two pipes of equal cross-sections and wall thickness along their whole length said method is carried out by a device comprising an extruding device with a reciprocating plunger in the extrusion space, said extrusion space being closed off, at the side facing the plunger, by an extrusion plate provided with the required number of extrusion openings, a preferably stationary mandrel extending through each of these openings, said device being characterized by a member which can be placed in the extrusion space between the extrusion plate and the starting workpiece (blank), said member limiting the transient space and forming a gap together with the outwardly directed side of each mandrel.

3 Claims, 4 Drawing Figures

METHOD FOR THE MANUFACTURE OF PIPES BY MEANS OF EXTRUSION AS WELL AS FOR PROVIDING ONE FLANGE ON AT LEAST TWO PIPES, AND DEVICE TO CARRY OUT THE SAID METHOD

The invention relates to a method for the manufacture of pipes by means of extrusion as well as for providing one flange on at least two pipes.

From the Dutch Patent Application No. 77,11204 a method is known to secure at least one pipe to a plate or a flange by means of welding under high pressure, in which a pipe is slid into a bore in the plate over a predetermined distance and, thereupon, the pipe material is spread over the wall of the bore and pressed against said wall under high pressure by means of a mandrel introduced into the pipe.

The method is so employed that the plate with a pipe slid into the bore at least over a predetermined distance is placed in a die with a punch, due to which the plate is supported practically on all sides, both die and punch being provided with bores facing each other to allow the passage of the pipe and the mandrel respectively, the diameter of said mandrel being such as to allow it to slide fittingly into the pipe and to be moved into the pipe through the bore in the die or punch from the plate surface opposite the surface in which the pipe is slid into the plate over said predetermined distance, the end of the mandrel in the pipe being situated within the bore in the opposite punch and die respectively; that, thereupon, such a compressive force is exerted upon the plate by the die and the punch that the plate and the pipe end become deformed, as a result of which plate material near the bore and material of the pipe end introduced therein is pressed against the mandrel at a great force under deformation of material, after which the mandrel is drawn from the bore while maintaining the pressure on the plate, all this in such a manner that the material of the pipe end is spread over the underlying bore wall and a welded joint develops. This method comprises a great many actions, among other things the manufacture of the pipes and the manufacture of the flange with bores to receive the required number of pipes, after which the pipes are placed in the respective bores of the flange and a mandrel is introduced into each pipe. Thereupon, the unit is pressurized such that the mandrel will start flowing and that the material of the respective pipe end is spread over the wall of the bore in the flange due to shifting of the mandrel and a pressure weld develops between pipe and flange. Each weld should be checked as to quality and tightness.

The invention aims at providing a method with which both pipes and flange can be formed integrally at the same time.

Extrusion of pipes is known. When the process or blank of extrusion is stopped before the starting workpiece or blank is fully extruded, one pipe integrated with a flange is obtained.

If it is attempted to extrude more pipes with one common integrated flange, the pipes thus formed are found not to come up to the requirements made. The sides of the pipes facing each other are incomplete or else the wall thickness there is less than in other places over the periphery of the pipes. In other words, the inner wall and the outer wall of the pipes are not mutually concentric, the wall part with the lesser thickness being situated at the interior of the pipes.

Up till now, it has proved impossible to form a flange with two or more pipes by means of extrusion, having a same cross-section and wall thickness over their entire length and periphery.

More particularly, the invention aims at providing a method for a simultaneous formation of a flange with a number of pipes by means of extrusion, by which method the aforesaid disadvantages are overcome.

According to the invention, this is achieved owing to these pipes being extruded simultaneously while a joint flange is formed at the same time, during which extrusion the material of the starting work-piece (blank), flowing under pressure, is forced, at a predetermined distance before the beginning of the extrusion openings for the pipes, to flow axially and radially into and through a transient space situated between said openings and the space reserved for the flange.

With the known extruding procedure of the type as described above, the flow of the material from the extrusion space to the extrusion openings takes place in the form of a fan, in other words, between axially in the centre line of the extrusion space and radially in the plane of the extrusion plate. This latter flow direction presents a sharp bend when reaching the respective extrusion opening due to which an interruption or a decrease in said flow will occur, resulting in the aforesaid unequal distribution of material in the pipe wall. By acting upon the above-mentioned flow pattern in such a manner that no or hardly any radial flow will occur near the inlet of the extrusion openings, an even distribution of the flowing material is achieved, due to which pipes with an even wall thickness over the entire cross-section and over the entire length are obtained.

Also, the invention relates to a device to carry out the aforesaid method, comprising an extruding device with a reciprocating plunger in the extrusion space, said space being closed, at the side opposite the plunger, by an extrusion plate provided with the required number of extrusion openings, a preferably stationary mandrel extending through each of these openings.

Most likely, the reason why, with a flow not influenced as stated above, those wall parts of the extruded pipes facing each other will have a lesser wall thickness, is that a difference in pressure will occur between the space outside the mandrels and the space enclosed by said mandrels. As a result of this, the mandrels might shift towards each other, thus causing a non-centred position and a difference in wall thickness of the extruded pipes.

To form the aforesaid transient space, a member is placed in the extrusion space between the extrusion plate and the basic workpiece (blank), said member defining the transient space and forming a gap together with the outwardly directed side of each mandrel. In principle, therefore, the extruding device may be of a known type with a plunger, in the space of which said member is placed. Due to the presence of said member, the flow of material is so influenced that a substantially axial flow will prevail more or less on the level with the plane of the extrusion plate. The said bend in the flow is shifted from the extrusion plate to that side of the member turned towards the plunger so that, on the level of the extrusion plate, the flow is no longer influenced thereby.

Preferably, the embodiment will be such that said member is an annular ring, the interior of which is situated at a distance from the circle circumscribing the mandrels, being substantially equal to the wall thickness of the pipes to be extruded.

Other embodiments of said member will be possible as long as the said gap is formed between the outwardly directed side of the periphery of the mandrels and the inner wall of the member. Over the remainder of the periphery of the mandrels, the inner wall of the member may have any form in principle, as will be described hereafter with the aid of exemplary embodiments.

Finally, the invention relates to a flange with at least two pipes, the flange and the pipes being extruded in one piece from a single starting workpiece (blank).

With the aid of a drawing, in which exemplary embodiments are shown, the invention will now be discussed in more detail.

Figure 1:
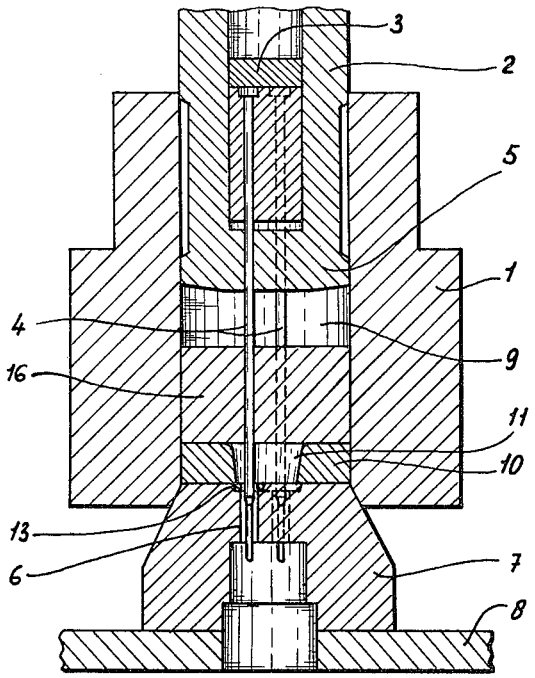
FIG. 1 shows a diagram of an extruding press in which the invention is put into practice.
Figure 2:
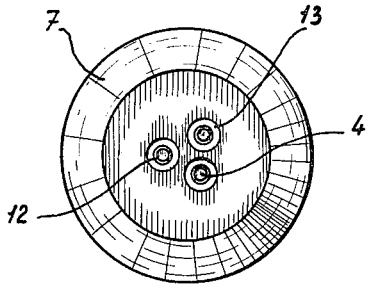
FIG. 2 shows the top of the extrusion plate.

The extruding device, which may be heated in a manner not represented here, consists of a casing 1, a reciprocating plunger 2 therein, in which a stationary bridge 3 is incorporated to which the mandrels 4 are connected which, through the head 5 of the plunger 2, extend into the extrusion openings 6 in the extrusion plate 7 which, in turn, is supported by a frame 8. In the extrusion space 9, defined by the plunger head 5 on one side and by the extrusion plate 7 on the other, a member is placed, having the form of a flat disc-shaped ring 10 with an opening 11 constituting the transient space mentioned earlier. Between the wall of the opening 11 and the exterior of the mandrels a gap 12 is formed. As shown, three mandrels 4 and three extrusion openings 6 are present.

The device operates as follows.

Figure 4:
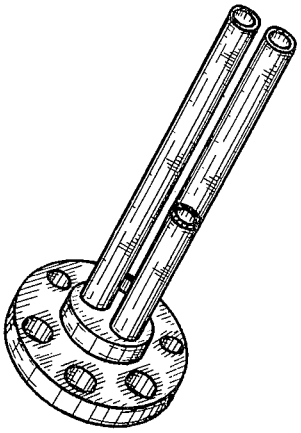
FIG. 4 shows a perspective of a flange with pipes obtained according to the invention.

Between the ring 10 and the head 5 of the plunger 2 a blank 16 made of starting material is placed, the volume of material of which is superior to that of the required pipes, said blank substantially filling the entire space 9 in radial direction. Thereupon, the whole is put under pressure. At a sufficiently high pressure, the material will start flowing and pass through the openings 6 into the extrusion plate 7, into which openings the mandrels 4 extend. At the lower end of the extrusion plate, the formed pipes (not represented here) emerge from the extrusion openings 6. As soon as the pipes will have the required length, the pressure is removed and the device is raised in such a manner that the extrusion plate 7, together with the flange formed on top and the pipes connected thereto, may be removed and the extrusion plate slid off the pipes. To realize a better guiding of the material, each end of the extrusion openings turned towards the plunger is provided with an extrusion ring 10 which should likewise be slid off the formed pipes. Now, a flange with pipes is obtained as shown in FIG. 4, after which the flange is provided with bores to be secured to an apparatus and with the necessary profiling (not represented here) to receive sealing means. The connection of the pipes to the flange is formed by an annular bead on the flange, said bead corresponding in its dimensions to the opening 11 of the ring 10.

Evidently, the ring 10 will not be essential when the space between the mandrels is sufficiently wide for the supply of the material between the mandrels. If was found that a ring 10 should be employed to realize workpieces consisting of a flange with two or more pipes, in which the diameter of the flange is superior to the diameter of said flange bead and the ratio of the pitch of the mandrels (i.e. the distance between the center lines of the mandrels) to the diameter of the pipe should lie between or be equal to 1 and 4 and the ring should meet the following requirements:

I. The height of the ring 10 in mm should be equal to or exceed the ratio $$\frac{80}{(\text{pitch}) - (\text{mandrel diameter})}$$

but not be under 5 mm.

II. At the least, the dimension of the gap 12 between the ring and the mandrel should equal the wall thickness of the pipe and at most it should equal the wall thickness of the pipe +3 mm.

A flange with three pipes formed from an aluminium alloy will e.g. have the following dimensions:

pipe $10\frac{5}{8}$ mm diameter pitch circle mandrels 10 mm radius linear distance between mandrels 17.32 mm.

In FIG. 3 a few different embodiments of the member to be placed in the extrusion space are shown.

Figure 3A:
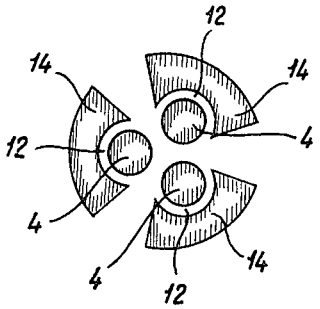
FIG. 3 shows a number of possible embodiments of the member.
Figure 3B:
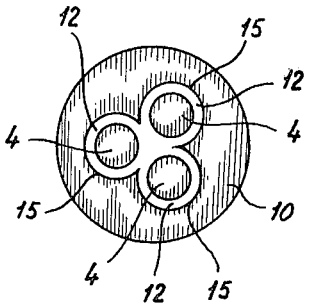

Since it will merely be necessary that a gap 12 is formed at the exterior of the mandrels, a member in the form of a number of segments 14 corresponding to the number of mandrels 4 will be sufficient (see FIG. 3*a*). Also, it will be possible to execute the ring as shown in FIG. 3*b*, where the interior of the ring is provided with recesses 15 partly encircling the mandrels while forming the required gap 12 between the exterior of the mandrels 4 and the interior of the recesses 15.

It will be evident that the present invention provides a method and device by which it will be possible to manufacture a number of pipes and an integrated flange by means of extrusion. The carrying out of a series of actions as described in the beginning is avoided herewith. Besides, the distances between the pipes may be kept extremely short. Finally, a check on quality and tightness as prescribed for a welded joint may be omitted since no welded joint is formed.

What is claimed is:

1. Method for making a flanged pipe construction by extrusion, in which there are formed simultaneously at least three pipes integrally connected to a common flange near the center of said flange, by extruding a blank placed in an extrusion space ultimately reaching the volume corresponding to said flange and said extrusion space having openings for said pipes, in which mandrels extend through said extrusion space and said openings for said pipes for forming the interior pipe space and the adjoining flange bores, in which upon extrusion the blank material in the extrusion space is forced to flow from a predetermined distance before reaching said openings for said pipes, axially and radially into and through a transient space located between the beginning of said openings for said pipes and said extrusion space and having a smaller cross section than said extrusion space, such that at the beginning of said openings for said pipes within said transient space all blank material between and around the mandrels is forced to flow mainly in axial direction in a uniform stream towards said openings for said pipes, in which the height of said transient space expressed in millimeters is at least equal to the ratio $$\frac{80}{(\text{pitch}) - (\text{mandrel diameter})},$$

but not under 5 millimeters and in which the distance between the side wall of said transient space and the most near mandrel surface is at least equal to the wall thickness of said pipes to be extruded.

2. Apparatus for making a flanged pipe construction, comprising an extrusion device having a reciprocating plunger in an extrusion space confined by side walls forming the guide walls for said plunger and an extrusion plate located opposite to said plunger, said extrusion plate having a number of openings, corresponding with the number of pipes to be formed, said plunger supporting a number of mandrels, corresponding with the number of pipes to be formed, each mandrel extending from the plunger through the extrusion space and through a corresponding opening in said extrusion plate, the exterior diameter of each mandrel being smaller than the interior diameter of a corresponding opening in which an extrusion space limiting member is placed on the extrusion plate, having at least one central opening, said opening forming the transient space and being of such shape that the height of said transient space expressed in millimeters is at least equal to the ratio $$\frac{80}{(\text{pitch}) - (\text{mandrel diameter})},$$

but not under 5 millimeters and in which the distance between the side wall of said opening and the most near mandrel surface is at least equal to the wall thickness of a pipe to be extruded.

3. Apparatus according to claim 2 wherein the opening in said extrusion space limiting member is of circular shape, and the circumference of said shape touching the most outer circumference point of each extrusion opening in said extrusion plate.

* * * * *